United States Patent [19]

Miller

[11] 4,430,752

[45] Feb. 7, 1984

[54] VALVED BAG WITH SEALING FLAP

[76] Inventor: Norman K. Miller, Concord Industrial Park, Concordville, Pa. 19331

[21] Appl. No.: 470,520

[22] Filed: Feb. 28, 1983

Related U.S. Application Data

[63] Continuation-in-part of Ser. No. 322,536, Nov. 18, 1981, and Ser. No. 433,246, Oct. 7, 1982.

[51] Int. Cl.[3] ..... F42B 03/00; B65D 30/22; B65D 30/24; B65D 33/14

[52] U.S. Cl. ..... 383/6; 383/44

[58] Field of Search ..... 150/9; 229/62.5

[56] References Cited

U.S. PATENT DOCUMENTS

| | | | |
|---|---|---|---|
| 2,119,895 | 6/1938 | Sutton | 150/9 X |
| 3,523,563 | 8/1970 | Mirando | 150/9 X |
| 3,783,787 | 1/1974 | Thornley et al. | 150/9 X |
| 3,806,025 | 4/1974 | Marshall | 150/9 X |
| 3,957,098 | 5/1976 | Hepworth et al. | 150/9 |

FOREIGN PATENT DOCUMENTS

| | | | |
|---|---|---|---|
| 2303795 | 8/1973 | Fed. Rep. of Germany | 229/62.5 |
| 1066427 | 4/1967 | United Kingdom | 150/9 |

*Primary Examiner*—William Price
*Assistant Examiner*—Sue A. Weaver
*Attorney, Agent, or Firm*—Robert K. Youtie

[57] ABSTRACT

A valved bag including elongate facing outer walls peripherally secured together except for an unsecured end region, an inner wall between the outer walls extending across the unsecured region and secured to one outer wall partially across the unsecured region to leave an access passageway, extensions on the inner and other outer wall extending across the unsecured region and secured together to close the unsecured region, and a sealing flap exteriorly of the inner wall extension and the adjacent region of the secured outer wall and secured thereto for removable sealing engagement with the later by internal pressure of the bag.

7 Claims, 5 Drawing Figures

FIG. 1
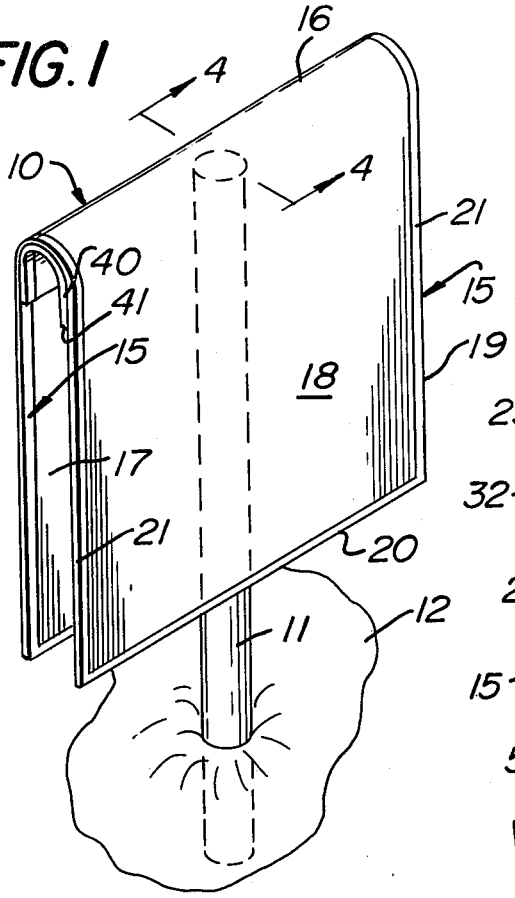
FIG. 3
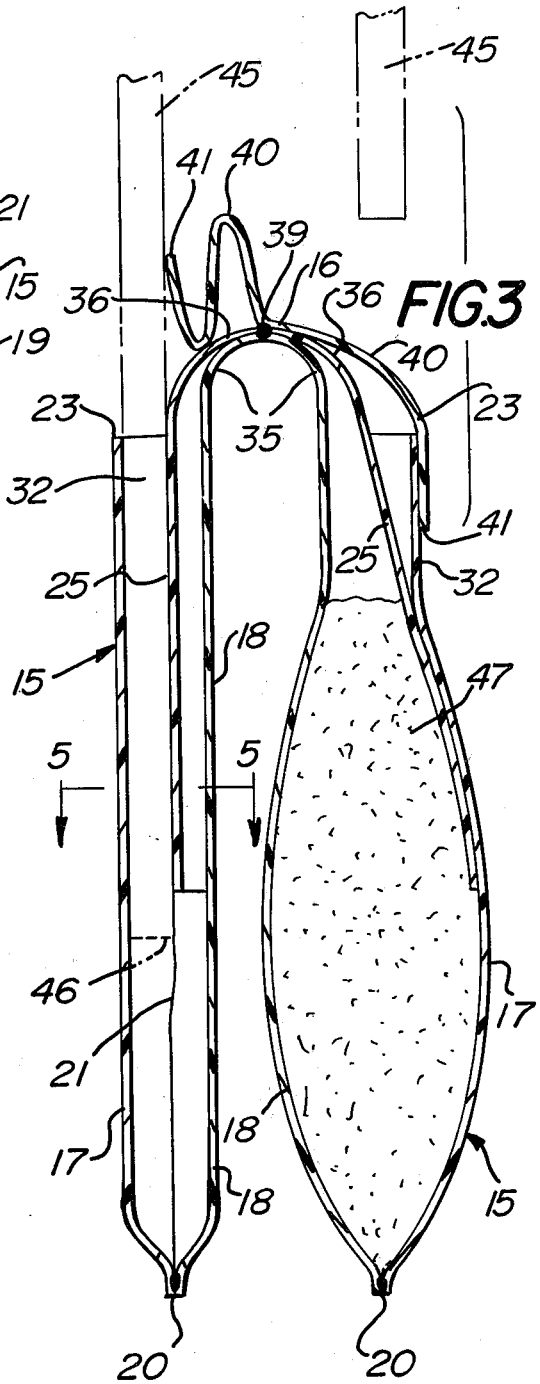
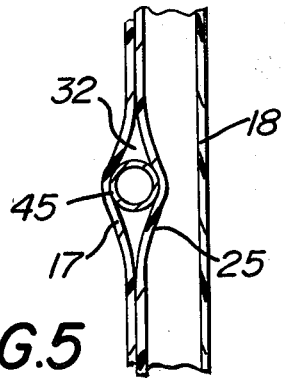
FIG. 5

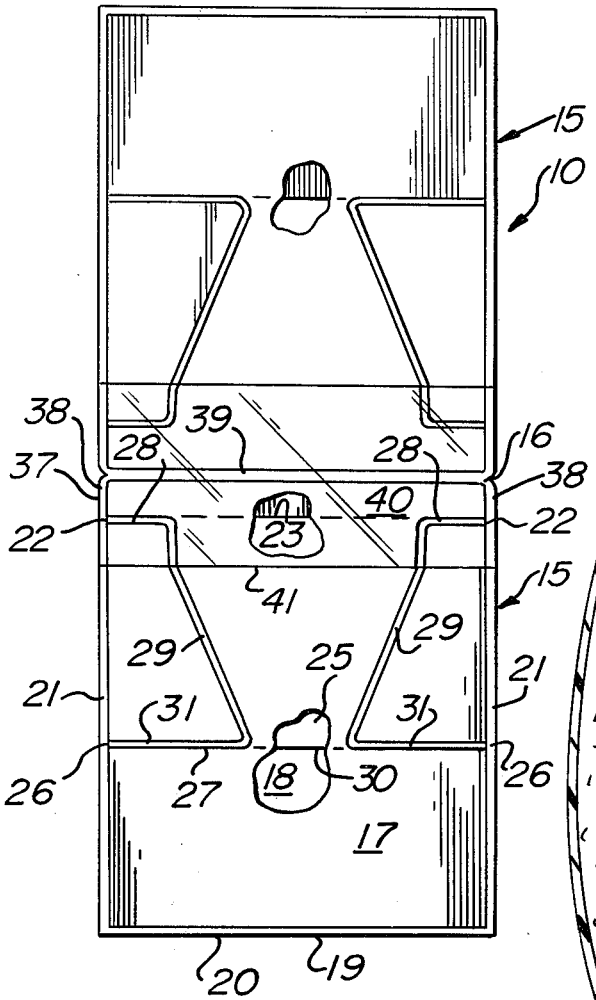
FIG. 2
FIG. 4
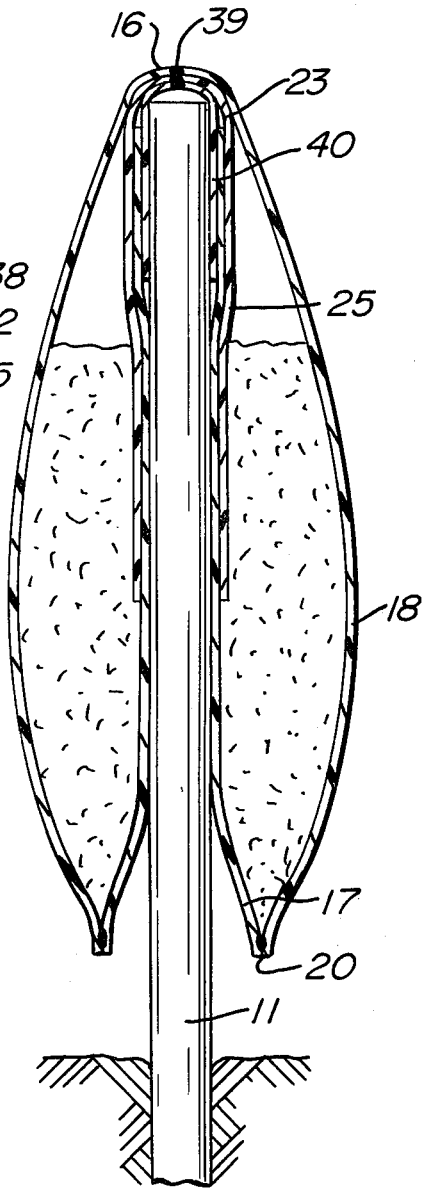

VALVED BAG WITH SEALING FLAP

CROSS REFERENCES TO RELATED APPLICATIONS

This application is a continuation-in-part of my copending U.S. Pat. applications Ser. No. 322,536 filed Nov. 18, 1981, and Ser. No. 433,246 filed Oct. 7, 1982.

BACKGROUND OF THE INVENTION

This invention is concerned with self-sealing, valved bags of the general type disclosed in my copending applications, and while embodying the advantages thereof over the prior art, includes additional advantages further enhancing reliability in use under the most abusive conditions.

While the bag construction described herein has been primarily developed and employed for use in containing explosive gel, and the like, for detonation thereof, and will be illustrated and described hereinafter with particular reference thereto, it is appreciated that the bag is capable of many varied uses and applications, all of which are intended to be comprehended herein.

SUMMARY OF THE INVENTION

It is an important object of the present invention to provide a self-sealing, valved bag of the general type disclosed in said copending patent applications, wherein reliability in use is even further enhanced by the provision of an additional self-sealing construction, so that the instant bags may be subjected even to abusive handling conditions after loading, without appreciable loss of contents or internal pressure.

It is a further object of the present invention to provide a self-sealing valved bag of the type described in the preceding paragraph which includes a sealing flap exteriorly of an outer bag wall and maintained in sealing engagement therewith by internal pressure of the bag.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a top perspective view showing a self-sealing valved bag of the present invention in its operative condition set for detonation.

FIG. 2 is a plan view of a bag construction of the present invention in an extended position and partly broken away to illustrate interior structure.

FIG. 3 is a longitudinal sectional view taken through the bag construction of FIGS. 1 and 2, showing a bag having a pair of contents receivers, one being illustrated as having been filled, and the other as having a filling conduit shown in phantom in a filling position.

FIG. 4 is a sectional elevational view taken generally along the line 4—4 of FIG. 1.

FIG. 5 is a parital sectional view taken generally along the line 5—5 of FIG. 3.

DESCRIPTION OF THE PREFERRED EMBODIMENT

Referring now more particularly to the drawings, and specifically to FIG. 1 thereof, a valved container of the present invention is there generally designated 10, being shown in position for detonation of explosive contents as supported by the upper end of an upright member or post 11 impaled in and upstanding from a ground surface 12. The container 10 includes a pair of bags or receptacles 15 connected together in end-to-end relationship, as at a connecting region 16, which connecting region may be supported on the upper end of post 11 with the pair of bags 15 depending on opposite sides of the post. The bags 15 may be substantially identical, so that a detailed description of one will suffice.

The bags 15 are each fabricated of flexible sheet material, such as vinyl, or the like, being cut into separate sheets and secured together, as by thermosealed regions or welds, but may be fabricated of other suitable material and otherwise secured together.

Each bag 15 may include a pair of elongate, generally rectangular, and substantially congruent outer walls 17 and 18, disposed in facing relation and peripherally secured together along an outline configuration by outer wall securing means 19, say by thermosealing or welding. In particular, the outer wall securing means may include a sealed region or seam 20 extending along and securing together the ends of outer walls 17 and 18, between opposite side edges thereof, and a pair of side seals or welds 21 extending in parallelism with each other from opposite ends of the end seam 20. The side outer wall securing seams 21 extend from the end seam 20, and are generally coterminous with the sides of the outer wall 17, terminating at the end edge 23 of the outer wall, approximately at points 22, 22.

Interposed between the outer walls 17 and 18 may be an inner wall 25, which may be of the same flexible sheet material as the outer walls, and extend laterally between opposite side edges of the outer walls, while spaced from the sealed end thereof. That is, the inner wall 25 may extend laterally between and have its opposite side edges secured to the side seams 21, as from the points 22 toward and terminating short of the end seam 20, as at points 26. The inner wall 25 is secured in facing relation with the outer wall 17 by inner wall securing means 27. Specifically, the inner wall securing means 27 may be constituted of thermally sealed regions or welds, including a pair of sealed portions 28 each extending laterally inward from respective point 22 to leave a central portion of inner wall edge 23 free. From the spaced inner ends of sealed portions 28, there extend respective sealed portions 29 in generally convergent relation toward each other and toward the end seal 20, but terminating short of each other and the end seal, approximately at the end edge 30 of the inner wall 25. The inner wall securing means 27 extends from the adjacent ends of seal portions 29, generally outwardly away from each other, as at 31, 31 along the inner wall edge 30 terminating approximately at the points 26 of the side seams 21.

Thus, the outer wall 17 and the inner wall 25, in the region between the inner wall securing seams 29, defines a generally convergent or funnel like passageway 32, see FIG. 5, when the wall portions are separated from each other. However, the passageway 32 is effectively closed by facing engagement of the portions of outer wall 17 and inner wall 25 between the seams 29, when the wall portions are in facing engagement.

Beyond the inner wall securing means 27 and points 22, the outer wall 18 is formed with a laterally coextensive, generally rectangular extension 35. Similarly, beyond the seal portions 28 and the outer wall end edge 21, the inner wall 25 is provided with a laterally coextensive end extension 36 generally congruent to and in facing relation with the outer wall extension 35. The extensions 35 and 36 are secured together by additional securing means 37, say comprised of a pair of sealed regions or welds 38, respectively being longitudinal extensions of side seams 21 beyond points 22, and a lateral or end seam 39 extending between the ends of side seams 38. Thus, it will now be apparent that the additional securing means 37 serves to close the interior of the bag 15, as between the inner wall 25 and outer wall 18, to the exterior of the bag. While the outer wall securing means 19, by its end seal 20 and side seals 21 serve to close one end of the bag 15, the additional securing means 37 by its end seal 39 and side seals 38 serve to close the other end of the bag. With the inner wall 25 in facing engagement with the outer wall 17, and retained in such facing engagement by internal bag pressure, the passageway 32 is effectively closed, and the bag is thereby well sealed.

However, under abusive handling conditions which may occur in the field, say for example with filled bags stacked one upon another and transported by truck over rough terrain, so as to repeatedly jostle the bags, it is possible that sharp variations in internal pressure, directions of orientation and movement, may permit of slight seepage from the bag interior to the passageway 32. Should such action be long continued, the contents may seep through and exit from the passageway 32.

An additional wall or flap 40, say of generally rectangular configuration and of flexible sheet material similar to the outer and inner walls, may be arranged outwardly of and overlying the inner wall extension 36 and adjacent portion of the outer wall 17. Specifically, the flexible outer sheet or sealing flap 40 may be generally rectangular in configuration, laterally coextensive with the outer walls 17 and 18, having one edge secured to the end edge of inner wall 25, as by seal 39, and having opposite edges secured to the inner wall by seals 38, and thence secured to the side edges of the outer wall 17 by seals 21. The flap extends longitudinally of the bag 15 from the end seal 39 to a free edge 41 which overlies the outer wall 17 and extends between the side seals 21.

As noted hereinbefore, both bags 15 may be essentially identical, and may be secured together in end to end relation at end seam 39. For manufacturing economy the outer wall extensions 35, 35 may be integral; and the inner wall extensions 36, 36 may be integral; and the sealing flaps 40, 40 may be integral, all secured by the end seal 39.

In FIG. 3 there is illustrated a bag filling procedure, wherein a filler tube 45 is inserted inwardly through the access passageway 32, having one end 46 entering the interior of the bag between the outer walls 17 and 18. Any fluent material, such as explosive gel, or other, may be introduced through the tube 45 into the bag 15. As best seen in FIG. 5, the regions of passageway 32 exteriorly and along side of the filler tube 45 permit of air escape during filling to minimize back pressure for rapid filling, and also to minimize resultant internal pressure within the bag after filling.

As best seen in FIG. 3, the sealing flap 40 may be displaced, by flexure thereof, to provide a straight path for insertion of the filler tube 45 through the straight access passageway 32 and therebeyond into the bag.

Removal of the filler tube 45 is shown on the right hand bag 15 of FIG. 3, the contents 47 remaining in the bag and pressing against the internal surface of inner wall 25 to maintain the inner wall in sealing engagement with the outer wall 17 and thereby close and seal the passageway 32.

Further, air trapped above the contents 47, between the walls 25 and 18, as well as any air trapped in the passageway 32 will displace the overlapped portion of wall 17, adjacent to edge 23, outwardly into sealed facing engagement with the overlapping portion of flap 40. Thus, the overlapping, facing engagement of flap 40 with the nether margin of outer wall 17, and maintenance in this sealing engagement by internal pressure, serves to provide a second, additional seal in series with the seal afforded by facing engagement between inner wall 25 and outer wall 17. These two sealing actions cooperate with each other, in that a single jostling or abusive handling procedure tending to effect seepage through one seal, would not tend to effect seepage through the other. For example, if internal pressure were momentarily released between the inner wall 25 and outer wall 17, as by shifting of pressure away from the end seam 20 and toward the end seam 39, such transfer would enhance the sealing action of the sealing flap 40.

While FIG. 3 illustrates one bag filled and the other bag beginning to be filled, it is appreciated that both bags may be filled simultaneously. Also, the provision of two bags 15 in end to end relation permits of a highly stable mounting on a post, by merely arranging the bags on opposite sides of the post, with the connecting portion 16 resting on the upper end of the post. This container position astride the post is highly stable, as the centers of gravity of the respective receptacles are relatively low, and does not require additional mounting means. Of course, suitable additional mounting means may be employed, if desired.

From the foregoing, it is seen that the present invention provides a valved bag with a sealing flap which fully accomplishes its intended objects and is otherwise well adapted to meet practical conditions of manufacture, filling and use.

Although the present invention has been described in some detail by way of illustration and example for purposes of clarity of understanding, it is understood that certain changes and modifications may be made within the spirit of the invention.

What is claimed is:

1. A valved bag for fluid contents comprising a pair of flexible sheet outer walls in facing relation with each other, outer wall securing means securing together said outer walls about a line configuration closed except for an unsecured region, a flexible sheet inner wall interposed between and in facing relation with said outer walls extending generally across said unsecured region, inner wall securing means securing together said inner wall and one of said outer walls for location of said inner wall in face to face sealing engagement with said one outer wall, said inner wall securing means extending less than entirely across said unsecured region to define an access passageway communicating between the interior of said outer walls and the exterior thereof when said inner and one outer walls are displaced away from each other, extensions on said inner and other outer walls extending beyond said one outer wall at said unsecured region, additional securing means securing together said inner and other outer wall extensions entirely across said unsecured region, said passageway being closed by pressure in said interior urging said inner wall in sealing engagement with said one outer wall, and a sealing flap exteriorly of said inner wall extension and the adjacent region of said one outer wall and secured by said additional and outer wall securing means, said flap being in sealing engagement with said one outer wall by the internal pressure of said bag.

2. A valved bag according to claim 1, said inner wall securing means comprising a pair of securing regions extending in convergent relation inwardly from said outer wall securing means, to define said access passageway in a funnel-like configuration, said inner wall securing means extending inwardly from said outer wall securing means on opposite sides of said access passageway, and said flexible sheet outer and inner walls being fabricated of plastic, said outer and inner wall securing means being sealed regions of said plastic.

3. A valved bag according to claim 1, said outer walls being elongate and said extensions being at one end of said outer walls, in combination with an additional like bag secured in end-to-end relation with said first mentioned bag for stable resting engagement astride an upright support.

4. A valved bag according to claim 3, said first mentioned and additional bags being secured in end-to-end relation with said extensions proximate to each other.

5. A valved bag according to claim 1, said outer walls being of generally congruent elongate configuration with said unsecured region at one end of said outer walls, and said inner wall extending generally laterally of and at one end of said outer walls.

6. A valved bag according to claim 5, said extensions being laterally coextensive with said inner and outer walls, and said sealing flap being laterally coextensive with said inner and outer walls and overlying the inner wall extension and the adjacent portion of said one outer wall.

7. A valved bag according to claim 6, said flexible sheet outer and inner walls and extensions being fabricated of plastic, and said securing means being sealed regions of said plastic.

* * * * *